United States Patent [19]

Busche

[11] 4,404,440

[45] Sep. 13, 1983

[54] APPARATUS FOR DETECTING WHEN THE PRESSURE DETECTOR IN A FLUID LINE EXCEEDS A PRESCRIBED THRESHOLD

[75] Inventor: William W. Busche, San Diego, Calif.

[73] Assignee: IVAC Corporation, San Diego, Calif.

[21] Appl. No.: 216,764

[22] Filed: Dec. 15, 1980

[51] Int. Cl.[3] ..... H01H 35/34

[52] U.S. Cl. ..... 200/83 R; 200/83 J; 200/81.9 R; 92/128

[58] Field of Search ..... 73/715, 717, 723; 340/611, 626; 92/94, 99, 128; 200/81 R, 81 H, 81.4, 81.5, 81.9 R, 245, 246, 83 R, 83 B, 83 J, 83 Z, 83 WM

[56] References Cited

U.S. PATENT DOCUMENTS

| | | | |
|---|---|---|---|
| 2,086,264 | 7/1937 | Gorschalki | 200/83 J |
| 2,996,588 | 8/1961 | Putnam | 200/83 J |
| 3,304,381 | 2/1967 | McAnespey | 200/83 J |
| 3,665,156 | 5/1972 | Lee | 200/83 R |
| 4,157,092 | 6/1979 | Fare | 92/128 |

*Primary Examiner*—G. P. Tolin

*Attorney, Agent, or Firm*—Fulwider, Patton, Rieber, Lee & Utecht

[57] ABSTRACT

A pressure detector for particular use in a system for administering parenteral fluid to a human patient. The pressure detector includes a conventional pressure diaphragm having a flexible membrane that is movable in accordance with the pressure of the fluid being administered. The pressure detector further includes a special receptacle for retaining the pressure diaphragm, and a special follower assembly that is moved in a prescribed fashion by installation of the diaphragm in the receptacle and by movement of the diaphragm membrane due to variations in fluid pressure. A pair of electrical contacts are controllably moved together and apart by the follower assembly, to provide an electrical signal whenever the diaphragm is not installed or, if it is installed, whenever the fluid pressure exceeds a prescribed threshold.

19 Claims, 4 Drawing Figures

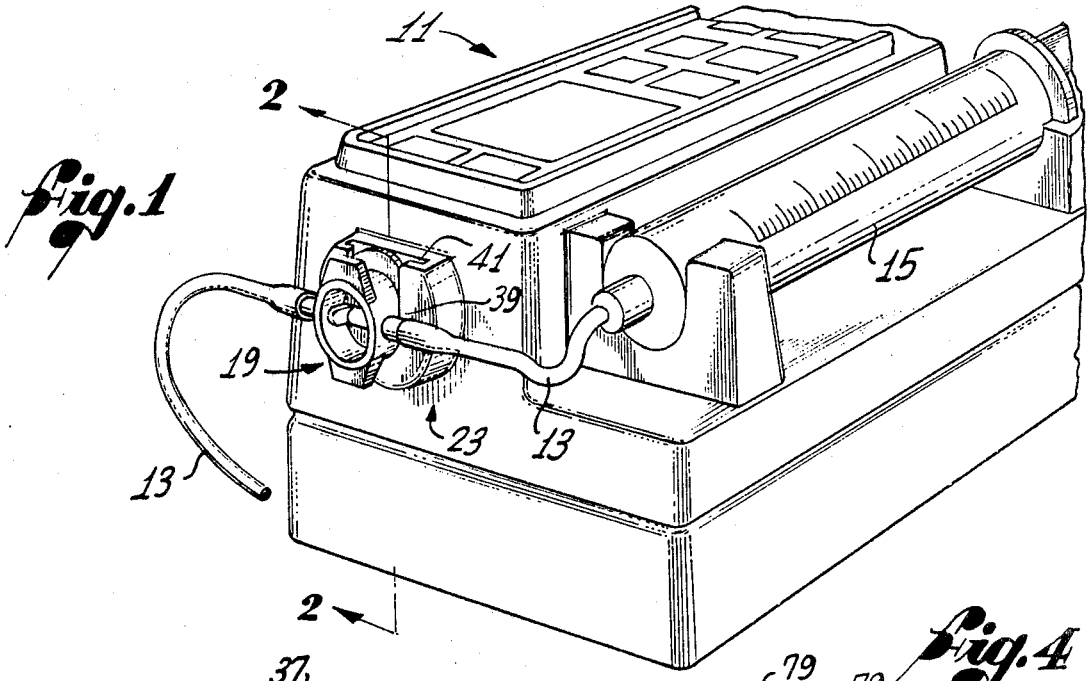
Fig. 1
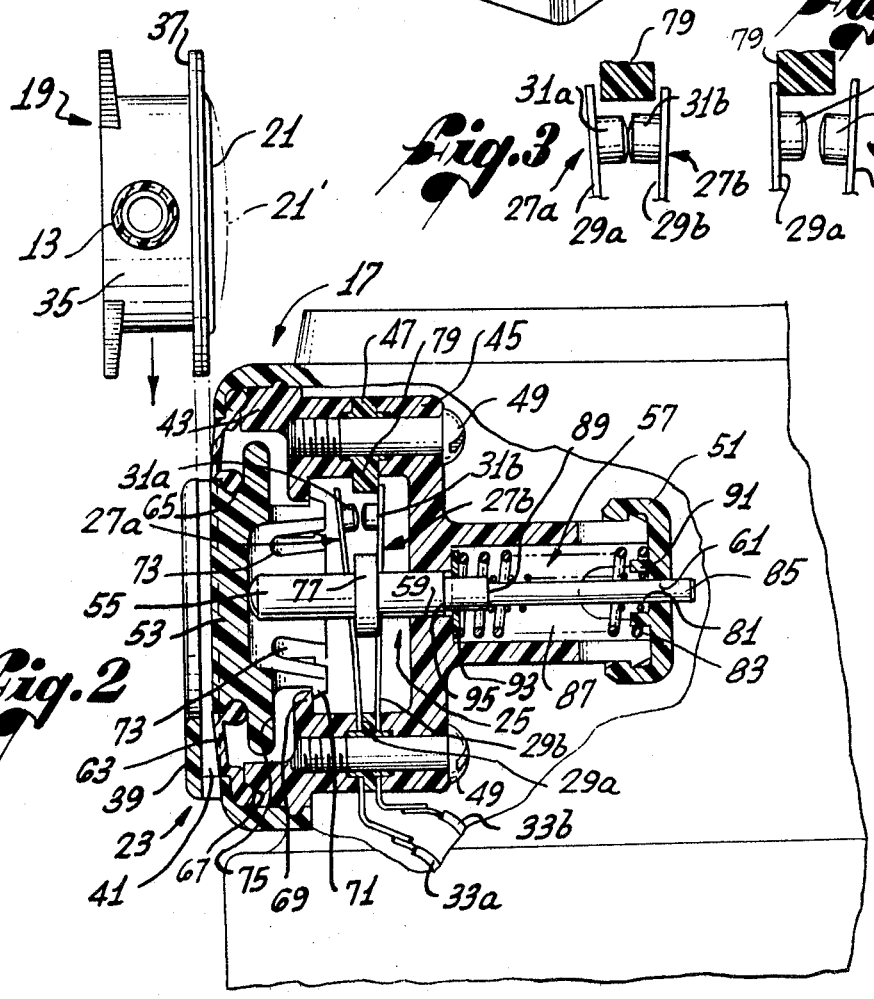
Fig. 2
Fig. 3
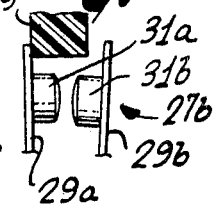
Fig. 4

APPARATUS FOR DETECTING WHEN THE PRESSURE DETECTOR IN A FLUID LINE EXCEEDS A PRESCRIBED THRESHOLD

BACKGROUND OF THE INVENTION

This invention relates generally to fluid pressure measurement, and, more particularly, to apparatus for detecting the pressure in a fluid line. The invention has particular application in connection with systems for administering parenteral fluids to the human body.

The administration of parenteral fluids to human patients conventionally involves use of a solution administration set. The set typically is a disposable plastic product, and includes a drip chamber adapted to be connected to a fluid source, a length of tubing extending from the chamber to the patient, and a valve mechanism, such as a roller clamp on the tubing.

In recent years, a variety of mechanical and electrical monitoring systems, controllers and infusion pumps have been developed to sense and regulate the rate of fluid flow into the human body. Such apparatus may include an electromechanical output device for manipulating the tubing of a conventional administration set in a prescribed manner, as by using a series of cam followers that sequentially massage the tubing and generate a peristaltic pumping action. For use in other apparatus, the tubing may include a syringe that is cyclically driven by the electromechanical output device through alternate fill and pump strokes, to draw and deliver precise amounts of fluid from the fluid source to the patient. Alternatively, instead of a conventional administration set, a self-contained syringe may be used in an apparatus designed for a single, controlled pump stroke, to deliver the fluid contained in the syringe to a patient.

A common feature of each of these apparatus is the capability of developing positive pressure in the tubing. Some of the apparatus have also been capable of activating alarms when an out-of-limit condition exists, thus freeing medical personnel to some extent for other duties.

Although such apparatus have generally served their purpose, there has been a need for an effective, safe and reliable means of sensing fluid pressure in the tubing leading to the patient. Specifically, concerns have been raised about the capability of monitoring and controlling the fluid pressure developed in the tubing by such positive pressure electromechanical devices.

Hence, those concerned with the development and use of fluid administration systems, and particularly those concerned with the design of parenteral administration systems, recognize the need for improvement in devices for fluid pressure measurement. The present invention fulfills this need.

SUMMARY OF THE INVENTION

The present invention resides in an apparatus for detecting the pressure in a fluid line and providing an electrical signal whenever the apparatus has not been properly initialized and whenever the pressure in the fluid line exceeds a prescribed threshold. The apparatus includes a pressure diaphragm communicating with the fluid line and having a flexible membrane that is movable in accordance with the fluid pressure in the line, along with a frame having means for retaining the pressure diaphragm in a prescribed position. In accordance with the invention, the apparatus further includes follower means mounted on the frame and movable in accordance with the position of both the pressure diaphragm and its flexible membrane, along with first and second electrical contact assemblies coupled to the frame and movable with respect to each other in accordance with movement of the follower means. The two contact assemblies provide the prescribed electrical signal whenever the pressure diaphragm is not installed in its prescribed position and, if it is installed, whenever the pressure in the fluid line exceeds the prescribed threshold.

More particularly, the apparatus of the invention has particular utility in a system for administering parenteral fluids to human patients. The flexible membrane of the pressure diaphragm is generally disc-shaped and the follower means includes a substantially planar face membrane for conforming engagement with the membrane. The pressure diaphragm further includes a flange around the periphery of the flexible membrane, and the retaining means includes an inwardly-projecting flange defining a slot for receiving the flange of the diaphragm and thereby removably retaining the diaphragm in its prescribed position.

In other aspects of the invention, each electrical contact assemby includes a flexible contact spring fixed at one of its ends to the frame and an electrical contact fixed to the free end of the contact spring. The follower means includes an axially-movable shaft with a collar that is disposed between the two contact springs and functions like a control finger to move the two contacts together and apart from each other in a prescribed fashion. The follower means further includes spring biasing means for urging the shaft and the face member outwardly in the direction of the installed pressure diaphragm.

The follower means is movable between an initial position, an intermediate position, and a high pressure position, in accordance with the position of the pressure diaphragm and its flexible membrane. When the diaphragm is not installed in the retaining means, the follower means is urged to the initial position, where the shaft collar engages the first contact spring and thereby urges the first contact away from the second contact. When the diaphragm is installed, and the fluid pressure does not exceed the prescribed threshold, the follower means is urged to the intermediate position, where the shaft collar is disposed intermediate the two contact springs and the two contacts are in electrical contact with each other. When the diaphragm is installed and the fluid pressure does exceed the threshold, the follower means is urged to the high pressure position, where the shaft collar engages the second contact spring and thereby urges the second contact away from the first contact.

The apparatus can further include finger means fixed to the frame and engagable with the contact springs of the two contact assemblies. Specifically, the finger means retains the second contact assembly whenever the contact spring of the first assembly is engaged by the follower means, and retains the first assembly whenever the contact spring of the second assembly is engaged by the follower means.

In yet another aspect of the invention, the spring biasing means of the follower means includes first and second spring means. The first spring means yieldably resists movement of the follower means from the initial position to the intermediate position, when the pressure diaphragm is installed. The second spring means engages the follower means only after it has moved to the intermediate position, and it yieldably resists further movement of the follower means to the high pressure position, in response to movement of the flexible membrane. In the preferred embodiment, the two spring means are in the form of coaxial, coil springs disposed around the follower shaft.

Other aspects and advantages of the present invention will become apparent from the following description of the preferred embodiment, taken in conjunction with the accompanying drawings, which illustrate, by way of example, the principles of the invention.

BRIEF DESCRIPTION OF THE DRAWINGS

FIG. 1 is a partial perspective view of a representative syringe infusion pump system utilizing a pressure detector embodying the principles of the present invention;

FIG. 2 is an enlarged, fragmentary sectional view of the pressure detector, taken along line 2—2 in FIG. 1 and showing a pressure diaphragm about to be installed and a pair of electrical contacts in a spaced-apart condition indicating that the diaphragm is not installed;

FIG. 3 is an enlarged, fragmentry sectional view of the pair of electrical contacts shown in contact with each other, indicating that the pressure diaphragm is installed and that the fluid pressure does not exceed a prescribed level; and FIG. 4 is an enlarged, fragmentary sectional view of the pair of electrical contacts shown in a spaced-apart condition, indicating that the pressure diaphragm is properly installed, but that the fluid pressure does exceed the prescribed threshold.

DESCRIPTION OF THE PREFERRED EMBODIMENT

Referring now to the drawings, and particularly to FIGS. 1 and 2, there is shown a pressure detector for use in a syringe infusion pump system 11 for administering parenteral fluid to a human patient. The fluid is delivered to the patient in a conventional fashion through a length of tubing 13 connected to a syringe 15. The pressure detector includes a frame 17 and a pressure diaphragm 19, which is coupled to the tubing and has a flexible membrane 21 that is movable in accordance with the fluid pressure in the tubing. In use, the pressure diaphragm is installed in a special receptacle 23 on the frame. The pressure detector provides an electrical signal whenever the pressure diaphragm is not installed in the receptacle, and, if it is installed, whenever the pressure in the tubing is determined to exceed a prescribed threshold.

In accordance with the invention, the pressure detector further includes a follower assembly 25 mounted in the frame 17, adjacent to the pressure diaphragm receptacle 23, for linear movement in accordance with movement of the flexible membrane 21, along with first and second electrical contact assemblies **27*a* and 27*b*, respectively, for producing the aforementioned electrical signal. Each contact assembly includes an enlongated, flexible contact spring 29*a* or 29*b* and an electrical contact 31*a* or 31*b*. The two contact springs are substantially parallel to each other and mounted at fixed ends thereof to the frame 17. The two electrical contacts are mounted on the free ends of their respective contact springs, in confronting relationship. The follower assembly is engagable with the two contact springs, to move the two electrical contacts apart from each other whenever the pressure diaphragm 19 is not installed in the receptacle or, if the diaphragm is properly installed, whenever the pressure in the tubing 13 exceeds the prescribed threshold. The aforementioned electrical signal is thereby provided on a pair of electrical leads 33*a* and 33*b* coupled to the respective contacts 31*a* and 31*b***.

More particularly, the pressure diaphragm 19 includes a rigid body portion 35 having an annular flange 37 that surrounds the flexible membrane 21. The resilient membrane is substantially planar and disc-shaped, in its unstressed condition, as shown by the solid line 21 in FIG. 2. As the fluid pressure in the tubing 13 increases, however, the membrane bulges outwardly from the flange by a corresponding amount, as shown by the phantom line 21' in FIG. 2. One pressure diaphragm suitable for use in the pressure detector of the present invention is disclosed more fully in a copending application for U.S. Patent, Ser. No. 216,650, entitled "Pressure Diaphragm", filed Dec. 15, 1980, in the name of Joel N. Cunningham et al, and assigned to the assignee of the present application.

The receptacle 23 for retaining the pressure diaphragm 19 in its prescribed position on the frame 17 includes an inwardly-projecting flange 39 that defines a slot 41 for receiving the outwardly-projecting flange 37 of the diaphragm. The diaphragm is installed by manually inserting its flange into the slot, where it is held in place by the follower assembly 25, which urges it outwardly against the inwardly-facing surface of the receptacle flange.

As previously mentioned, the pressure detector frame 17 provides support for the diaphragm receptacle 23 and also houses the follower assembly 25 and the first and second electrical contact assemblies **27*a* and 27*b*. It includes an outer housing member 43, an inner housing member 45, and a spacer ring 47, secured rigidly together by any suitable means, such as screws 49. The spacer ring is interposed between the outer and inner housing members, with the fixed end of the first contact spring 29*a* positioned between the outer member and the spacer ring, and the fixed end of the second contact spring 29*b* positioned between the inner member and the spacer ring. The frame further includes an end cap 51** fixed to the inner housing member. All of the frame elements are preferably molded from a suitable plastic material, to provide electrical insulation for the two contact springs.

The follower assembly 25 includes a face member 53, a shaft 55, and spring biasing means 57, all axially aligned with each other and housed within the frame 17. The shaft is urged outwardly by the spring biasing means into engagement with the face member, which, in turn, is urged into engagement with the flexible membrane 21 of the installed pressure diaphragm 19. The shaft is slidably received in bores 59 and 61 formed in the inner housing member 45 and the end cap 51, respectively. The face member 53 is retained in its position in the frame by a flexible, annular ring 63 that is seated in annular seats 65 and 67 formed in the face member and the outer housing member 43, respectively. The annular ring also functions to seal the interior of the frame, to prevent contamination by dust and other foreign particles. The face member is also retained within the frame by an inwardly-projecting annular flange 69 on the outer housing member, which functions as a stop for an outwardly-projecting annular lip 71 on the face member. The face member further includes a plurality of circumferentially-spaced slots 73, to facilitate insertion of the face member lip 71 past the outer housing member flange 69. A shoulder 75 on the face member is engagable with the outer housing member flange, to prevent insertion of the face member too far into the frame.

In one aspect of the invention, the follower shaft 55 includes a collar 77 that projects into the spacing between the two contact springs 29*a* and 29*b*. The collar functions as a control finger that engages the contact springs and thereby moves the two electrical contacts 31*a* and 31*b* toward or away from each other in accordance with the position of the shaft.

In operation, when the pressure diaphragm 19 is not installed in the receptacle 23, the follower shaft 55 and face member 53 are urged outwardly by the spring biasing means 57, as depicted in FIG. 2. In this outward or initial position, the shaft collar 77 engages the first contact spring 29*a*, to move it and the first contact 31*a* away from the second contact spring 29*b* and the second contact 31*b*. This provides an open circuit condition on the two electrical leads 33*a* and 33*b*. When the pressure diaphragm is properly installed in the receptacle, and the pressure in the tubing 13 does not exceed the prescribed threshold, the follower shaft and face member are moved by the diaphragm to an intermediate position, against the resistance of the spring biasing means. In this intermediate position, the shaft collar is disposed intermediate the two contact springs, to allow the two electrical contacts to contact each other, as depicted in FIG. 3. This provides a closed circuit condition on the two electrical leads.

If the pressure in the tubing 13 increases, the face member 53 and shaft 55 are urged inwardly by the diaphragm membrane 21 against the resistance of the spring biasing means 57. When the pressure exceeds the prescribed threshold, the resistance of the spring biasing means is overcome, and the face member and shaft are moved to a high pressure position. In this position, the shaft collar 77 engages the second contact spring 29*b*, to move it and the second contact 31*b* away from the first contact spring 29*a* and the first contact 31*a*. This restores the open circuit condition in the two electrical leads 33*a* and 33*b*. If the fluid pressure again drops below the prescribed threshold, the spring biasing means urges the shaft, and thus the shaft collar, outwardly, to bring the second contact back into electrical contact with the first contact (FIG. 3).

In the preferred embodiment, the pressure detector further includes a finger 79 integral with the spacer ring 47 of the frame 17 and disposed between the two contact springs 29*a* and 29*b*. It functions to retain the second contact spring 29*b* whenever the shaft collar 77 engages the first contact spring 29*a* (FIG. 2), and to retain the first contact spring whenever the collar engages the second contact spring (FIG. 4).

The spring biasing means 57 for urging the follower assembly 25 outwardly against the flexible membrane 21 of the pressure diaphragm 19 includes first and second coil springs 81 and 83, respectively. The two springs surround a reduced-diameter portion 85 of the follower shaft 55, in a chamber 87 formed by the inner housing member 45 and the end cap 51.

The first coil spring 81 is disposed between a first annular shoulder 89 on the follower shaft 55 and the inner face of the end cap 51, inside an annular spring retaining wall 91. It provides a continuous outward force on the shaft, to urge the follower assembly to the initial position whenever the pressure diaphragm 19 is not installed. The force is small enough to be overcome readily by a manual insertion of the diaphragm into the receptacle 23.

The second coil spring 83 surrounds the first spring 81 and is disposed between a flat ring 93 that surrounds the shaft 55 at the outer end of the chamber 87, and the inner face of the end cap 51, immediately outside the spring retaining wall 91. The follower shaft 55 includes a second annular shoulder 95 engagable with the flat ring, and thus the second spring, only when the shaft has been urged inwardly by the diaphragm membrane 21 to the intermediate position (FIG. 3). Only when the pressure in the fluid line exceeds the prescribed threshold, is there sufficient force to overcome the biasing force of the second spring, and thereby to move the follower assembly 25 to the high pressure position.

It will be appreciated from the foregoing description that the present invention provides an improved pressure detector for particular use in a system for administering parenteral fluid to a human patient. The pressure detector includes a conventional pressure diaphragm having a flexible membrane that is movable in accordance with the pressure of the fluid being administered. The detector further includes a special follower assembly and an associated pair of electrical contacts, for detecting both an installation of the pressure diaphragm and the relative position of its flexible membrane and thereby providing an electrical signal whenever the diaphragm is not installed and, if it is installed, whenever the fluid pressure exceeds a prescribed threshold.

Although the invention has been described with reference to its presently preferred embodiment, it should be understood by those of ordinary skill in the art that various modifications can be made without departing from the spirit and scope of the invention. Accordingly, it is not intended that the invention be limited, except as by the appended claims.

I claim:

1. Apparatus for detecting the pressure in a fluid line, comprising:

a pressure diaphragm communicating with a fluid line and having a flexible membrane that is movable in accordance with the pressure in the fluid line;

a frame having means for removably retaining the pressure diaphragm in a prescribed position;

follower means mounted on the frame and movable in accordance with the position of the pressure diaphragm and the flexible membrane thereof; and first and second electrical contact assemblies mounted on the frame and movable with respect to each other in accordance with movement of the follower means, the two contact assemblies providing a binary electrical signal, wherein the signal is in a first state whenever the pressure diaphragm is not retained in its prescribed position and whenever the pressure diaphragm is retained in its prescribed position and the pressure in the fluid line exceeds a prescribed threshold, and wherein the signal is in a second, opposite state whenever the pressure diaphragm is retained in its prescribed position and the pressure in the fluid line does not exceed the prescribed threshold.

2. Apparatus as defined in claim 1, wherein:

the first and second electrical contact assemblies are both movable with respect to the frame;

the first contact assembly is engaged by the follower means and thereby urged away from the second contact assembly whenever the pressure diaphragm is not retained in its prescribed position; and the second contact assembly is engaged by the follower means and thereby urged away from the first contact assembly whenever the pressure diaphragm is retained in its prescribed position and the pressure in the fluid line exceeds the prescribed threshold.

3. Apparatus as defined in claim 2, wherein:

the first and second electrical contact assemblies each include an elongated, flexible contact spring mounted on the frame; and the follower means includes first finger means positioned between the contact springs of the first and second contact assemblies, the first finger means being engagable with the contact springs to urge the first and second contact assemblies apart from each other in the prescribed fashion.

4. Apparatus as defined in claim 3, and further including second finger means fixed to the frame and engagable with the contact springs of the first and second electrical contact assemblies, to retain the second contact assembly whenever the first assembly contact spring is engaged by the first finger means, and to retain the first contact assembly whenever the second assembly contact spring is engaged by the first finger means.

5. Apparatus as defined in claim 1, wherein:

the pressure diaphragm includes a flange adjacent the periphery of the flexible membrane; and the means for removably retaining the pressure diaphragm includes means defining a slot for receiving the pressure diaphragm flange and thereby removably retaining the pressure diaphragm in the prescribed position, the slot being oriented substantially perpendicular to the direction of movement of the follower means.

6. Apparatus as defined in claim 5, wherein the follower means includes a substantially planar face for conforming engagement with the flexible membrane of the pressure diaphragm.

7. Apparatus as defined in claim 1, and further including means for biasing the follower means toward the prescribed position for the pressure diaphragm, whereby whenever the pressure diaphragm is retained in the prescribed position, the follower means is maintained in contact with the flexible membrane.

8. Apparatus as defined in claim 7, wherein:

the biasing means includes first spring means and second spring means;

whenever the pressure diaphragm is not retained in its prescribed position, the follower means is urged by the first spring means to an initial position wherein the first and second electrical contact assemblies are out of electrical contact with each other;

whenever the pressure diaphragm is retained in its prescribed position and the pressure in the fluid line does not exceed the prescribed threshold, the follower means is moved by the flexible membrane of the pressure diaphragm to an intermediate position, against the urging of the first spring means, wherein the first and second contact assemblies are in electrical contact with each other; and whenever the pressure diaphragm is retained in its prescribed position and the pressure in the fluid line exceeds the prescribed threshold, the follower means is moved by the flexible membrane of the pressure diaphragm to a high pressure position, against the urging of the second spring means, wherein the first and second contact assemblies are out of electrical contact with each other.

9. Apparatus for detecting the pressure in a fluid line, comprising:

a pressure diaphragm communicating with a fluid line and having a rigid member and a flexible membrane that is movable in accordance with the pressure in the fluid line;

a frame having a receptacle for removably retaining the pressure diaphragm in a prescribed position;

follower means mounted on the frame adjacent the prescribed position for the pressure diaphragm, for movement between an initial position, an intermediate position, and a high pressure position, in accordance with the position of the pressure diaphragm and movement of its flexible membrane; and first and second electrical contact assemblies, each assembly having an electrical contact and an elongated flexible contact spring fixed at one of its ends to the frame, the contact springs of the two assemblies being substantially parallel to each other;

wherein the follower means is engagable with the contact springs of the first and second contact assemblies, to urge the electrical contacts apart from each other and thereby provide an open circuit electrical signal whenever the pressure diaphragm is not retained by the receptacle, in which case the follower means is in the initial position, and whenever the pressure diaphragm is retained by the receptacle and the pressure in the fluid line exceeds a prescribed threshold, in which case the follower means is in the high pressure position;

and wherein the follower means permits the electrical contacts to contact each other and thereby provide a closed circuit electrical signal whenever the pressure diaphragm is retained by the receptacle and the pressure in the fluid line does not exceed the prescribed threshold, in which case the follower means is in the intermediate position.

10. Apparatus as defined in claim 9, wherein:

the follower means includes first finger means positioned between the contact springs of the first and second contact assemblies and engagable therewith;

the first finger means urges the electrical contact of the first contact assembly away from the electrical contact of the second contact assembly when the follower means is in the initial position; and the first finger means urges the electrical contact of the second contact assembly away from the electrical contact of the first contact assembly when the follower means is in the high pressure position.

11. Apparatus as defined in claim 10, and further including second finger means fixed to the frame and engagable with the contact springs, to retain the second contact assembly whenever the contact spring of the first assembly is engaged by the first finger means, and to retain the first contact assembly whenever the contact spring of the second assembly is engaged by the first finger means.

12. Apparatus as defined in claim 9, wherein:

the rigid member of the pressure diaphragm includes an outwardly-projecting flange adjacent the periphery of the flexible membrane; and the receptacle for removably retaining the pressure diaphragm includes means defining a slot for receiving the pressure diaphragm flange and thereby removably retaining the pressure diaphragm in the prescribed position, the slot being oriented substantially perpendicular to the direction of movement of the follower means.

13. Apparatus as defined in claim 12, wherein the follower means includes a substantially disc-shaped, planar face for conforming engagement with the flexible membrane of the pressure diaphragm.

14. Apparatus as defined in claim 9, and further including means for biasing the follower means toward the prescribed position for the pressure diaphragm, whereby whenever the pressure diaphragm is retained in the prescribed position, the follower means is maintained in contact with the flexible membrane.

15. Apparatus as defined in claim 14, wherein:

the biasing means includes first spring means and second spring means;

whenever the pressure diaphragm is not retained in its prescribed position, the follower means is urged by the first spring means to an initial position wherein the electrical contacts of the first and second electrical contact assemblies are out of electrical contact with each other;

whenever the pressure diaphragm is retained in its prescribed position and the pressure in the fluid line does not exceed the prescribed threshold, the follower means is moved by the flexible membrane of the pressure diaphragm to an intermediate position, against the urging of the first spring means, wherein the electrical contacts of the first and second contact assemblies are in electrical contact with each other; and whenever the pressure diaphragm is retained in its prescribed position and the pressure in the fluid line exceeds the prescribed threshold, the follower means is moved by the flexible membrane of the pressure diaphragm to a high pressure position, against the urging of the second spring means, wherein the electrical contacts of the first and second contact assembles are out of electrical contact with each other.

16. Apparatus as defined in claim 15, wherein:

the follower means includes an axially-movable shaft; and the first and second spring means include coaxial coil springs surrounding the axially-movable shaft.

17. Apparatus for detecting the pressure in a fluid line, comprising:

a pressure diaphragm communicating with a fluid line and having a rigid member and a flexible membrane that is movable in accordance with the pressure in the fluid line;

a frame having a receptacle for removably retaining the pressure diaphragm in a prescribed position;

follower means mounted on the frame adjacent the prescribed position for the pressure diaphragm, for linear movement between an initial position, an intermediate position, and a high pressure position, in accordance with the position of the pressure diaphragm and movement of its flexible membrane; and first and second electrical contact assemblies, each assembly having an electrical contact and an elongated, flexible contact spring fixed at one of its ends to the frame, the contact springs of the two assemblies being substantially parallel to each other;

wherein the follower means includes face means for engagement with the flexible membrane, finger means for engagement with the contact springs of the first and second contact assemblies, and biasing means for urging the face means and the finger means toward the prescribed position for the pressure diaphragm, whereby whenever the pressure diaphragm is retained in its prescribed position, the face means is maintained in contact with the flexible membrane;

wherein whenever the pressure diaphragm is not retained by the receptacle, the follower means is in the initial position and the finger means thereof urges the electrical contact of the first contact assembly away from the electrical contact of the second contact assembly;

wherein whenever the pressure diaphragm is retained by the receptacle and the pressure in the fluid line does not exceed a prescribed threshold, the follower means is in the intermediate position and the electrical contacts of the first and second contact assemblies are in electrical contact with each other;

and wherein whenever the pressure diaphragm is retained by the receptacle and the pressure in the fluid line does exceed the prescribed threshold, the follower means is in the high pressure position and the finger means thereof urges the electrical contact of the second contact assembly away from the electrical contact of the first contact assembly.

18. Apparatus as defined in claim 17, wherein:

the biasing means includes first spring means and second spring means;

the follower means is urged to the intermediate position by the flexible membrane of the pressure diaphragm, against the resistance of the first spring means; and the follower means is urged to the high pressure position by the flexible membrane of the pressure diaphragm, against the resistance of the second spring means.

19. Apparatus as defined in claim 17, wherein:

the rigid member of the pressure diaphragm includes an outwardly-projecting flange around the periphery of the resilient membrane; and the receptacle for removably retaining the pressure diaphragm includes means defining a slot for receiving the flange of the pressure diaphragm and thereby removably retaining the pressure diaphragm in the prescribed position, the slot being oriented substantially perpendicular to the direction of movement of the follower means.

* * * * *

UNITED STATES PATENT AND TRADEMARK OFFICE

CERTIFICATE OF CORRECTION

PATENT NO. : 4,404,440

DATED : Sep. 13, 1983

INVENTOR(S) : William W. Busche

It is certified that error appears in the above—identified patent and that said Letters Patent is hereby corrected as shown below:

IN THE TITLE:

Delete "APPARATUS FOR DETECTING WHEN THE PRESSURE DETECTOR IN A FLUID LINE EXCEEDS A PRESCRIBED THRESHOLD" and insert therefor -- APPARATUS FOR DETECTING WHEN THE PRESSURE IN A FLUID LINE EXCEEDS A PRESCRIBED THRESHOLD --.

Signed and Sealed this

*Seventeenth* Day of *January 1984*

[SEAL]

*Attest:*

GERALD J. MOSSINGHOFF

*Attesting Officer*

*Commissioner of Patents and Trademarks*